US009975124B2

(12) United States Patent
Rose et al.

(10) Patent No.: US 9,975,124 B2
(45) Date of Patent: May 22, 2018

(54) EVAPORATION OF SOLVENTS FROM SAMPLES

(71) Applicant: Genevac Limited, Suffolk (GB)

(72) Inventors: Symon Rose, Suffolk (GB); Robert Hugh Douglas Darrington, Suffolk (GB); John Michael Poole, Suffolk (GB); Graham Broadbent, Suffolk (GB); Donald Roger Lee-Smith, Suffolk (GB); Richard John Smith, Suffolk (GB)

(73) Assignee: Genevac Limited, Suffolf (GB)

( * ) Notice: Subject to any disclaimer, the term of this patent is extended or adjusted under 35 U.S.C. 154(b) by 0 days. days.

(21) Appl. No.: 14/415,858

(22) PCT Filed: Jul. 24, 2013

(86) PCT No.: PCT/GB2013/051982

§ 371 (c)(1),
(2) Date: Jan. 20, 2015

(87) PCT Pub. No.: WO2014/016599

PCT Pub. Date: Jan. 30, 2014

(65) Prior Publication Data

US 2015/0202623 A1 Jul. 23, 2015

(30) Foreign Application Priority Data

Jul. 24, 2012 (GB) ..... 1213162.9

(51) Int. Cl.

| | |
|---|---|
| ***B01L 3/00*** | (2006.01) |
| ***B01L 9/00*** | (2006.01) |
| ***B01L 3/06*** | (2006.01) |

(52) U.S. Cl.

CPC ..... *B01L 3/50825* (2013.01); *B01L 3/06* (2013.01); *B01L 3/50853* (2013.01); *B01L 9/00* (2013.01);

(Continued)

(58) Field of Classification Search

CPC .... B01L 3/50825; B01L 3/06; B01L 3/50853; B01L 9/00

(Continued)

(56) References Cited

U.S. PATENT DOCUMENTS 5,112,574 A 5/1992 Horton
5,217,572 A * 6/1993 Guy ..... B01D 1/14 159/16.1

(Continued)

FOREIGN PATENT DOCUMENTS

DE 203 07 913 U1 9/2003
EP 0 128 778 A1 12/1984

(Continued)

OTHER PUBLICATIONS

Espacenet, English Machine Translation of EP1652787A1, published May 3, 2006, retrieved from http://worldwide.espacenet.com on Jan. 19, 2015 (9 pages).

(Continued)

*Primary Examiner* — Jill A Warden
*Assistant Examiner* — Benjamin R Whatley
(74) *Attorney, Agent, or Firm* — Wood Herron & Evans LLP

(57) ABSTRACT

Apparatus and methods are provided relating to evaporation of solvents from samples and to prolonging the time taken to carry out an evaporation procedure. A cap for engaging with an open end of a sample container comprises an engaging surface for engaging with the open end, and a body portion which extends over the open end. The body portion (Continued)

is preformed to define an opening which provides a fluid pathway between the open end of the container and the surroundings of the container, such that the cap impedes vapor flow from a sample in the container to the surroundings of the container. A holder for receiving a plurality of such caps is also provided and a method of evaporating a solvent from a sample in a sample container is described.

19 Claims, 3 Drawing Sheets

(52) U.S. Cl.
CPC ..... *B01L 3/5025* (2013.01); *B01L 2200/028* (2013.01); *B01L 2200/0678* (2013.01); *B01L 2200/0694* (2013.01); *B01L 2300/047* (2013.01); *B01L 2300/048* (2013.01); *B01L 2300/10* (2013.01); *B01L 2400/0409* (2013.01)

(58) Field of Classification Search
USPC ..... 422/529
See application file for complete search history.

(56) References Cited

U.S. PATENT DOCUMENTS

| | | | | |
|---|---|---|---|---|
| 5,342,581 | A | 8/1994 | Sanadi | |
| 5,501,839 | A | 3/1996 | Tarantino | |
| 5,918,289 | A * | 6/1999 | Scheppers | G01N 1/26 73/863.21 |
| 6,382,476 | B1 * | 5/2002 | Randall | B65D 47/0885 215/237 |
| 6,500,390 | B1 * | 12/2002 | Boulton | B01J 19/0046 215/247 |
| 2002/0009391 | A1 * | 1/2002 | Marquiss | B01L 3/50853 422/63 |
| 2005/0086830 | A1 | 4/2005 | Zukor et al. | |
| 2010/0080733 | A1 | 4/2010 | Carlson et al. | |
| 2011/0143452 | A1 | 6/2011 | Che et al. | |

FOREIGN PATENT DOCUMENTS

| | | | |
|---|---|---|---|
| EP | 1 652 787 | A1 | 5/2006 |
| EP | 2 098 295 | A1 | 9/2009 |
| EP | 2 119 497 | A1 | 11/2009 |
| FR | 2 934 506 | A1 | 2/2010 |
| WO | 99/20394 | A3 | 4/1999 |
| WO | 2013/014413 | A1 | 1/2013 |

OTHER PUBLICATIONS

Espacenet, English Machine Translation of FR2934506A1, published Feb. 5, 2010, retrieved from http://worldwide.espacenet.com on Jan. 19, 2015 (7 pages).

Intellectual Property Office of the United Kingdom, Patents Act 1977: Search Report Under Section 17(5), Application No. GB1213162.9, dated Mar. 21, 2013 (5 pages).

Intellectual Property Office of the United Kingdom, Patents Act 1977: Search Report Under Section 17(6), Application No. GB1213162.9, dated Jun. 27, 2013 (2 pages).

European Patent Office, International Search Report and Written Opinion of the International Searching Authority, International Application No. PCT/GB2013/051982, dated Mar. 5, 2014 (16 pages).

Wikipedia, Desiccator from Wikipedia, the free encyclopedia, retrieved on Jan. 19, 2015 from http://en.wikipedia.org/wiki/Desiccator (1 page).

* cited by examiner

EVAPORATION OF SOLVENTS FROM SAMPLES

CROSS REFERENCE TO RELATED APPLICATIONS

This application is a submission under 35 U.S.C. § 371 of International Application No. PCT/GB2013/051982, filed Jul. 24, 2013, which claims priority to Great Britain Application No. 1213162.9, filed Jul. 24, 2012, the disclosures of which are hereby expressly incorporated by reference herein in their entireties.

FIELD OF THE INVENTION

The present invention relates to evaporation of solvents from samples and more particularly to prolonging the time taken to carry out an evaporation procedure.

BACKGROUND OF THE INVENTION

Evaporators are used in chemical and biochemical laboratories to evaporate solvents from samples. Generally, it is desirable to carry this out in a time efficient manner. However, in some processes, it may be preferable to carry out the evaporation relatively slowly. For example, when the aim is to grow crystals, the quality and characteristics of those crystals may be dependent on the rate of evaporation.

SUMMARY OF THE INVENTION

The present invention provides a cap for engaging with an open end of a sample container, comprising:

an engaging surface for engaging with the open end; and a body portion which extends over the open end and has a surface which is preformed to define an opening, the opening providing a fluid pathway between the open end of the container and the surroundings of the container, such that the cap impedes vapour flow from a sample in the container to the surroundings of the container.

Thus, rather than evaporating the solvent directly from the open end of the sample container, a relatively restricted fluid pathway is defined by the cap between the interior of the container and its surroundings. The configuration of that fluid pathway may be selected by selection of an appropriate cap in order to provide the desired degree of restriction to flow of solvent vapour from the sample. By extending over the open end (without closing it), the cap constricts the fluid pathway to some extent. It impedes or throttles the flow of vapour away from the sample, thereby controlling the rate of evaporation. This rate may therefore be varied by selecting a cap configuration to suit a particular solvent or solvent/sample combination, giving the desired evaporation rate.

The engaging surface may be provided by the body portion or by another component of the cap.

The cap may comprise a plurality of body portions. Thus, the assembly of body portions together defines the fluid pathway between the interior of the container and its surroundings. Each body portion may have the same configuration. Alternatively, two or more of the body portions may have different configurations, to provide different degrees of restriction to the vapour flow.

A cap comprising a plurality of body portions may define a series of interconnected chambers. It is believed that during an evaporation procedure this results in the solvent vapour concentration increasing from chamber to chamber towards the open end of the container. This considerably suppresses the evaporation, particularly when the chamber with the highest vapour concentration approaches saturation.

The or each body portion may comprise a lamina, which may extend transversely with respect to the direction of fluid flow. For example, the or each lamina may define a central, circular opening, providing the fluid pathway through the lamina. A cap may include two or more laminae. Each lamina may define an opening having the same shape and size. Alternatively, two or more laminae may define openings having different configurations.

The cap may comprise a selectable number of body portions. In this way, the fluid path through the cap may be varied to suit particular requirements, with a greater number of body portions providing a greater impediment to the flow of vapour.

The volume enclosed over the sample container by the cap may be selected by choosing an appropriate cap configuration. For example, the distance between the open end of the container and the body portion (or the outermost body portion) may be selected accordingly. The size of this volume may influence the rate of evaporation.

The cap may comprise a plurality of interchangeable body portions which are selectively, mutually engageable and/or interconnectable in a stack formation. A modular approach may be preferable, with the cap formed from an assembly of selected body portions. Each body portion may be a sliding fit with an adjacent body portion. They may be temporarily attached, for example by means of a snap fitting, complementary screw threads, or a bayonet fitting, for example.

The cap may include a plurality of interchangeable spacers which are selectively engageable and/or interconnectable in a stack and configured to selectively retain a body portion between adjacent spacers. The spacers may be selectively attached together using one of the approaches noted above. In a preferred arrangement, a lamina body portion is held around its periphery between adjacent spacers. The combination of spacers and body portions forming the cap may be selected to provide the desired degree of restriction to the flow of vapour from a sample in a container.

A fluid-tight seal is preferably provided between the peripheries of each two adjacent body portions or spacers in a stack. This serves to prevent vapour from leaking out of the sides of the cap, from between the components of the cap. The seal may be a member formed of a compressible material.

Any loss of vapour from between outer edges of the adjacent body portions or spacers of the cap may be further minimized by selecting a seal material which exhibits little or no vapour adsorption, such as a perfluoro-elastomer for example.

In preferred embodiments, the mass of the body portion or spacer which is uppermost in use of the stack is greater than that of the other body portions or spacers in the stack. This serves to increase the effectiveness of the seals between the body portions or spacers by pressing them together and so compressing the seals further.

The present invention further provides a holder for receiving a plurality of caps as described herein, wherein the holder defines an array of receiving locations, each location being configured to receive and locate a respective cap. The array may be configured to correspond to an array of sample containers for engagement with a corresponding cap.

A channel through the holder may be defined at each cap receiving location, with each channel configured to receive the respective cap via one end, and to define a retaining surface which prevents the cap from passing all the way through the channel. In this way, a cap may be inserted and retained at each location, and lifting the holder will lift all the caps together with it simultaneously.

The cap inserted at each location in the holder may have a configuration selected according to the rate of evaporation required from the associated sample. Thus, two or more caps may define respective fluid pathways having different configurations.

The cap and cap holder configurations described herein are particularly suitable for use in centrifugal evaporation equipment.

The present invention also provides a method of evaporating a solvent from a sample in a sample container, comprising:

(a) locating the container in a chamber;

(b) at least partially evacuating the chamber;

(c) venting the interior of the chamber to the ambient atmosphere;

(d) circulating gas in the chamber; and (e) repeating steps (b) to (d) a plurality of times.

This approach facilitates close control of the rate of evaporation from the sample and may be carried out over a prolonged period.

Circulation of the gas in the chamber may be carried out by rotating the container around a rotational axis in the chamber which is spaced from the container. Centrifugal evaporation equipment is particularly suitable for carrying out the method. For example, a centrifuge may be provided in the chamber. Alternatively, gas may be circulated relative to a stationary sample by exerting a force on the gas in another manner, such as a rotating fan.

The rate of evaporation from the sample in the container is preferably controlled by engaging a cap as described herein with an open end of the container. A plurality of containers may be located in the chamber and a respective cap engaged with each container, the configuration of each cap being selected to provide a desired degree of restriction to the flow of vapour from the corresponding sample.

BRIEF DESCRIPTION OF THE DRAWINGS

Embodiments of the present invention will now be described by way of example and with reference to the accompanying schematic drawings, wherein.

DETAILED DESCRIPTION OF THE INVENTION

Figure 1:
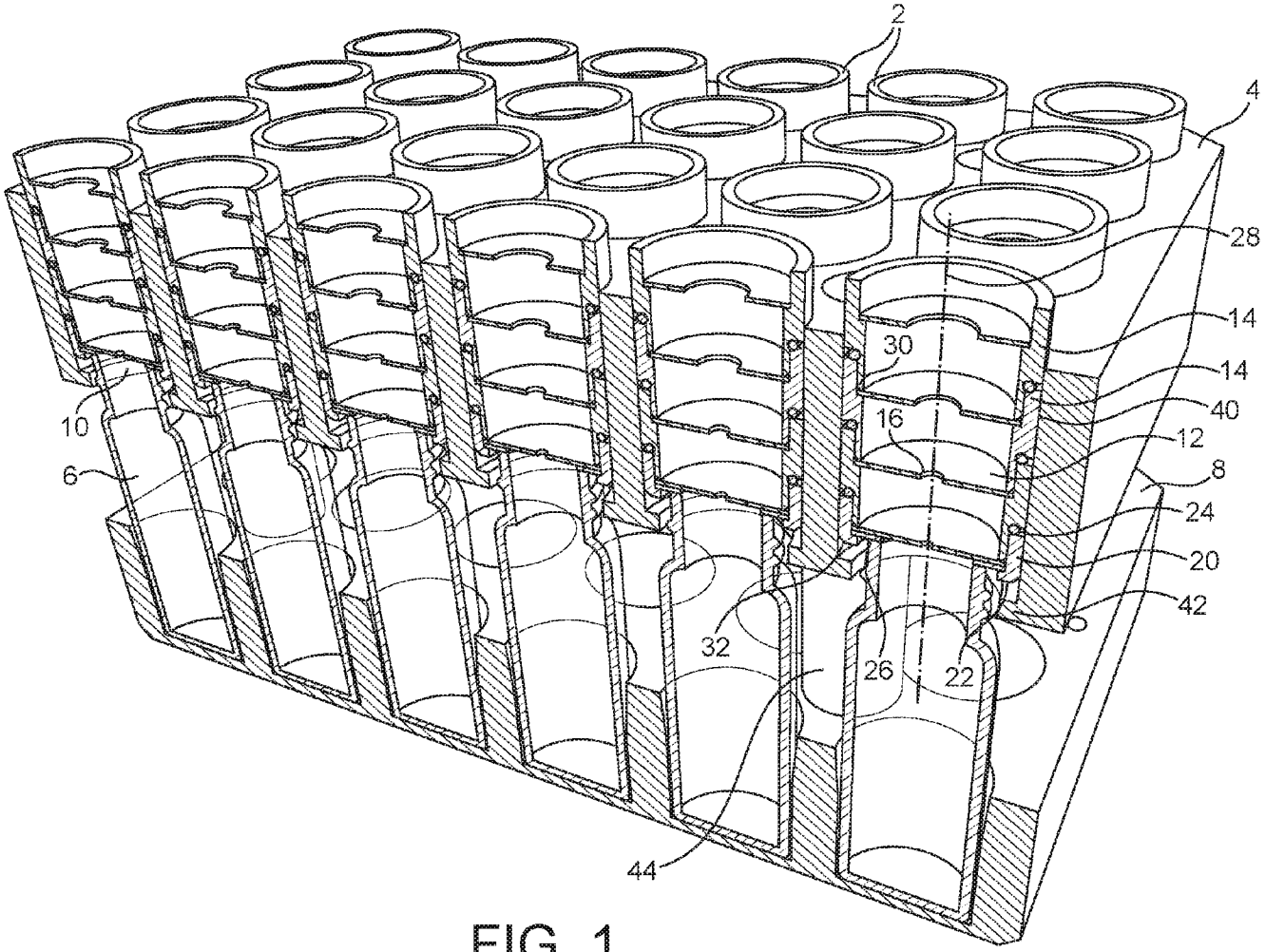
FIGS. 1 and 2 show a perspective cross-sectional view of an array of caps held in a holder in engagement with an array of sample vials carried by a support, and a cross-sectional partial side view of a closely similar arrangement, respectively.

In the Figures, an array of caps 2 is shown. The caps are located in a holder 4. A corresponding array of sample vials 6 is carried by a support 8. The open end 10 of each vial is in engagement with the lower end of a respective cap 2. The Figures show cross-sections in a vertical plane running centrally through a row of caps.

Each cap includes four annular laminae 12 spaced apart by three spacers 14. The laminae and spacers are formed from an inert material, such as polypropylene. For ease of manufacture, it may be preferable to form the laminae from stainless steel for example.

A Circular opening 16 is defined centrally in each lamina. In the configuration of FIG. 1, the openings defined by the four laminae in each cap have different diameters. The diameter of the opening increases with the distance of the respective lamina from the container.

Figure 2:
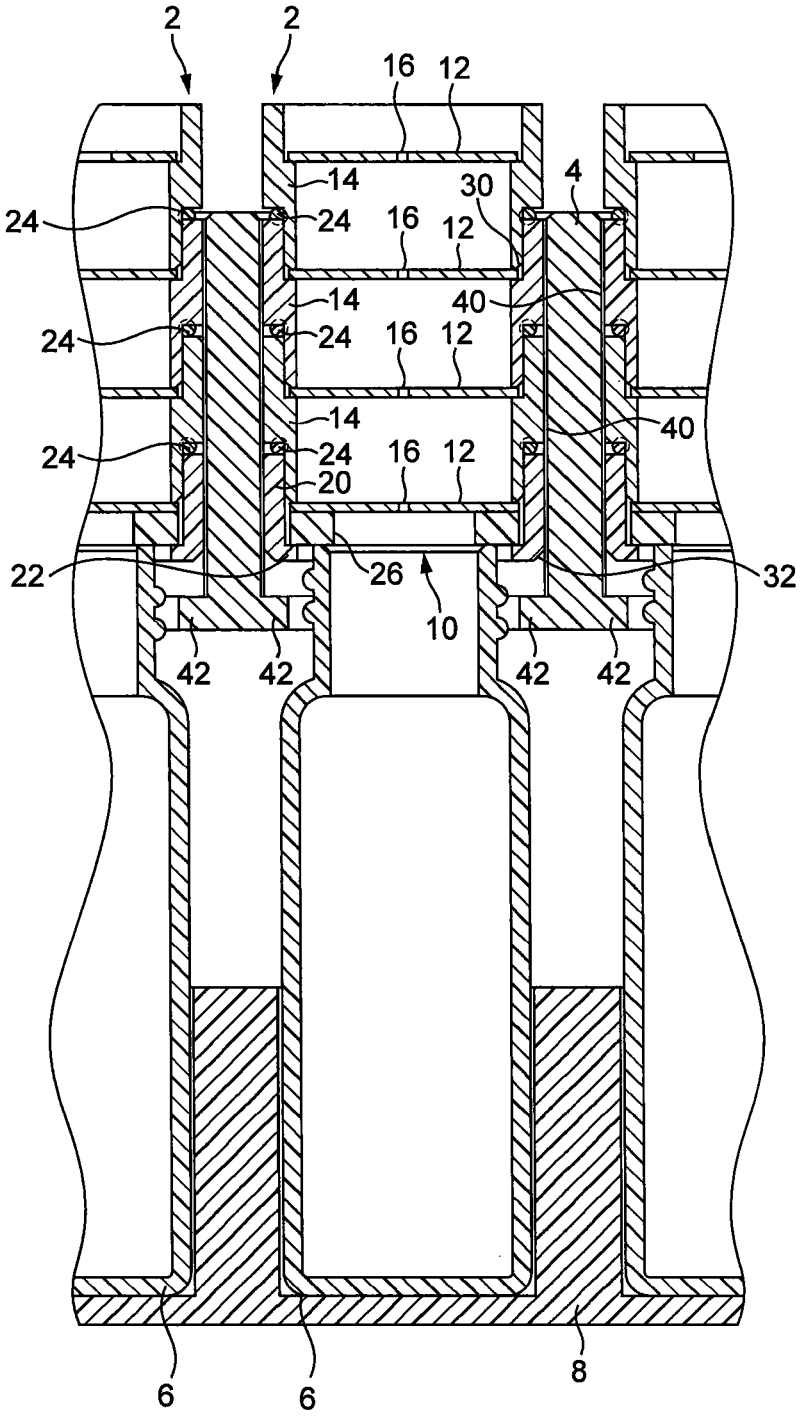

In FIG. 2, all the openings 16 have the same diameter.

The spacers 14 fit together to form a stack having a generally cylindrical hollow formation. The lowermost spacer is in engagement with a retaining member 20. A lamina 12 is held between adjacent spacers, with a further lamina held between the lowermost spacer and an inwardly extending flange 22 formed on the retaining member. The uppermost lamina is supported by the uppermost spacer 14.

Each spacer 14 is releasably coupled to each adjacent spacer, with the lowermost spacer releasably coupled to the retaining member 20. Each coupling may be in the form of a snap-fit coupling for example. This may be provided in the form of a projecting feature received in a recess defined by the adjacent spacer or retaining member, or vice versa. A compressible seal 24 is provided between adjacent spacers to prevent vapour from escaping through the side walls of the cap. An annular seal 28 is held between the retaining member and the lowermost lamina 12. Seal 28 extends inwardly sufficiently far to provide a surface for engagement with the open end 10 of the vial 6.

The seals are annular. They are formed of a material which exhibits little or substantially no vapour adsorption, such as a perfluoro-elastomer for example. Selection of a seal with this property was found to substantially reduce loss of vapour via the sidewalls of the caps.

An end portion of each spacer is received in a corresponding opening in the spacer or retaining member below. The periphery 30 of the end portion of each spacer may be chamfered to assist location in the adjacent spacer or retaining member, and similarly the periphery 32 of the underside of the retaining member may be chamfered to assist location of the cap assembly in the holder.

Each cap 2 is held in a respective receiving location 40 defined by the holder 4. Each receiving location is in the form of a channel extending perpendicular to the plane of the holder and having a cylindrical surface complementary to the cylindrical outer profile of the cap 2. A lip or flange 42 extends inwardly from the lower end of each receiving location 40 for engaging the lower end of each cap when it is inserted. As with the caps, the holder is formed from an inert material such as polypropylene.

The array of receiving locations corresponds to the positions of the vials 6 held in support 8. Cylindrical posts 44 (see FIG. 1) extend upwardly from the support 8 and corresponding recesses are defined in the underside of the holder 4.

Although the caps shown in the Figures all have the same combination of laminae provided in them, the configuration of each cap may be individually and independently selected to suit particular requirements. For example, one or more of the laminae may be omitted or replaced with another lamina having a different size of opening.

In use of the configurations shown in the Figures, initially each cap is configured with the desired arrangement of laminae, depending on the sample to be provided in the associated container. The cap is then inserted in the corresponding position in the array of receiving locations in the holder 4. The sample vials 6 are loaded into the support 8. The holder is lined up with the array of vials by engaging posts 44 with the corresponding recesses in the underside of holder 4. The posts extend sufficiently far into the holder to enable the caps to be brought into engagement with the open ends of the respective vials and then space the retaining lips 42 from the undersides of the caps.

Once the evaporation process has been completed, all the caps may be removed simultaneously by simply lifting the holder 4 from the support 8.

The support and holder 4 may be configured so as to be suitable for mounting in a centrifugal evaporator. When used in this way, centrifugal forces acting on the caps will press them firmly against the open ends of the containers and also exert a compressive force on the components of each cap, increasing the integrity of the seals between the components. The holder also ensures that the caps are held in place even when high accelerations (of the order of 400-500 g, for example) are exerted in a centrifugal evaporator.

Figure 3:
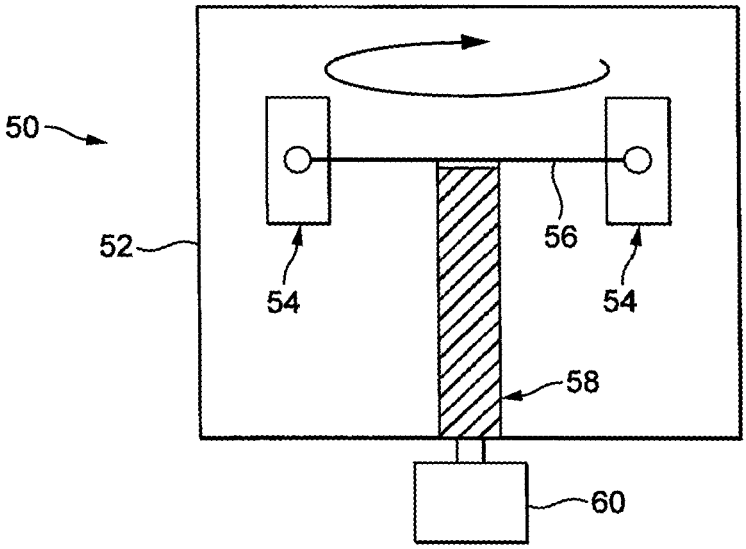
FIG. 3 shows a centrifugal evaporator.

An example of a known centrifugal evaporator configuration for use in combination with embodiments of the present invention is shown in FIG. 3. The evaporator 50 has a chamber 52 which contains a pair of carriers 54. The carriers are pivotally mounted on a rotor 56. The rotor is rotated by a shaft 58 driven by a motor 80. In use, a support 8 carrying sample containers 6 which are in engagement with caps 2 held within a holder 4 (these components are not shown in FIG. 3) is loaded into each carrier 54. The rotor is then rotated whilst a vacuum is applied to the chamber and the samples are heated (by means not shown in the Figure).

The caps described herein are configurable by selecting the number and shape of the laminae. The laminae (or the single lamina when only one is selected) define one or more interconnected chambers above the open end of the container. These parameters may be varied to control the rate of evaporation.

In some evaporation procedures, it is desirable to extend the evaporation over a prolonged period. For example, in some cases the aim is to grow crystals from each sample. The crystal growth is induced by making an even-increasingly saturated solution by very slow evaporation. The conditions required for slow evaporation may vary considerably between different solvents. Prior to the present invention, this would mean that each solvent would need to be processed separately. The ability to select a dedicated cap configuration according to the present invention may enable a range of solvents to be evaporated at substantially the same rate, for example over a number of days.

A preferred technique for slow evaporation has been developed involving the creation of a partial vacuum over the samples and then releasing this vacuum to atmosphere, in cycles which may each last of the order of tens of minutes for example. The gas drawn in from the ambient atmosphere is circulated over the samples. This may be achieved by means of mechanical circulation by a fan for example, or by spinning the samples in a centrifuge.

The samples may be provided in a chamber in fluidic communication with a condenser. As the chamber is pumped down to create the partial vacuum, which may be of the order of 50 mbar for example, the gas and vapour drawn from the chamber flow to the condenser.

While the present invention has been illustrated by description of various embodiments and while those embodiments have been described in considerable detail, it is not the intention of applicant to restrict or in any way limit the scope of the appended claims to such details. Additional advantages and modifications will readily appear to those skilled in the art. The invention in its broader aspects is therefore not limited to the specific details and illustrative examples shown and described. Accordingly, departures may be made from such details without departing from the spirit or scope of Applicants' invention.

What is claimed is:

1. A modular, configurable cap for engaging with an open end of one sample container, comprising:

a single cap, including:

an engaging surface for engaging with the open end; and a plurality of a selectable number of interchangeable body portions selectively, mutually engageable and/or interconnectable in a stack formation, each of the plurality of interchangeable body portions being interchangeable with each other, each of which extends over the open end and has a surface which is preformed to define an opening, the openings providing a fluid pathway between the open end of the container and the surroundings of the container, such that the cap impedes vapour flow from a sample in the container to the surroundings of the container; and a plurality of interchangeable spacers which are selectively engaged and/or interconnected to form a stack, each of the plurality of interchangeable spacers being interchangeable with each other, and configured to selectively retain one of the body portions between adjacent spacers, the body portions and intervening spacers together defining a series of interconnected chambers forming said fluid pathway.

2. The cap of claim 1, wherein at least two of the body portions define respective openings having different configurations.

3. The cap of claim 1, wherein each body portion comprises a lamina.

4. The cap of claim 3, wherein each lamina defines a central, circular opening.

5. The cap of claim 4, wherein at least two laminae define central, circular openings having different diameters.

6. The cap of claim 1, wherein the plurality of body portions are selectively engaged to form a stack.

7. The cap of claim 6, including a seal between adjacent body portions in the stack.

8. The cap of claim 7, wherein the seal exhibits substantially no vapour adsorption.

9. The cap of claim 8, wherein the seal is formed of a perfluoro-elastomer.

10. The cap of claim 6, wherein a mass of the body portion which is uppermost of the stack is greater than that of each of the other body portions in the stack.

11. The cap of claim 1, including a seal between adjacent spacers in the stack.

12. The cap of claim 11, wherein the seal exhibits substantially no vapour adsorption.

13. The cap of claim 12, wherein the seal is formed of a perfluoro-elastomer.

14. The cap of claim 11, wherein a mass of the spacer which is uppermost of the stack is greater than that of each of the other spacers in the stack.

15. A holder in combination with a plurality of separate caps, each separate cap being modular and independently configurable, and being for engaging with an open end of one sample container, wherein the holder defines an array of receiving locations, each location being configured to receive and locate a respective separate cap, wherein each separate cap comprises:

an engaging surface for engaging with the open end; and a plurality of a selectable number of body portions, each of the plurality of body portions being interchangeable with each other, each of which extends over the open end and has a surface which is preformed to define an opening, the openings providing a fluid pathway between the open end of the container and the surroundings of the container, with the body portions of the cap defining a series of interconnected chambers forming said fluid pathway, such that the cap impedes vapour flow from a sample in the container to the surroundings of the container.

16. The combination of claim 15, wherein a channel through the holder is defined at each location, each channel being configured to receive the respective cap via one end, and to define a retaining surface which prevents the cap from passing all the way through the channel.

17. The combination of claim 15, wherein at least two of the caps define respective fluid pathways having different configurations.

18. A centrifugal evaporator in combination with a sample container engaged by the cap of claim 1.

19. A centrifugal evaporator in combination with at least one sample container received in a support and in engagement with a respective cap located in the holder of claim 15.

* * * * *